US007845509B2

(12) United States Patent
Burchard

(10) Patent No.: US 7,845,509 B2
(45) Date of Patent: Dec. 7, 2010

(54) LID FOR A BEVERAGE CONTAINER TO HOLD A DECOCTION BEVERAGE

(75) Inventor: Jörn Burchard, Seevetal (DE)

(73) Assignee: Hälssen & Lyon, Hamburg (DE)

( * ) Notice: Subject to any disclaimer, the term of this patent is extended or adjusted under 35 U.S.C. 154(b) by 1280 days.

(21) Appl. No.: 11/299,882

(22) Filed: Dec. 12, 2005

(65) Prior Publication Data

US 2006/0180028 A1 Aug. 17, 2006

(30) Foreign Application Priority Data

Feb. 11, 2005 (EP) ..... 05002924

(51) Int. Cl.

| | |
|---|---|
| ***B65D 51/18*** | (2006.01) |
| ***A47G 19/22*** | (2006.01) |
| *B65B 29/02* | (2006.01) |
| *A23L 1/00* | (2006.01) |

(52) U.S. Cl. ..... 220/254.1; 220/713; 220/717; 220/718; 426/77; 99/275; 229/404

(58) Field of Classification Search ..... 220/711, 220/713, 717, 718, 254.1, 254.3, 255, 253, 220/705, 712; 229/404; 99/283; 426/77, 426/80, 83

See application file for complete search history.

(56) References Cited

U.S. PATENT DOCUMENTS

| | | | | |
|---|---|---|---|---|
| 2,146,096 | A * | 2/1939 | Slocum | 426/81 |
| 2,328,599 | A * | 9/1943 | Armstrong | 99/295 |
| 3,360,161 | A * | 12/1967 | Smith | 220/719 |
| 4,331,255 | A * | 5/1982 | Fournier | 220/257.2 |
| 5,531,347 | A * | 7/1996 | Goulding | 220/212 |
| 5,657,898 | A * | 8/1997 | Portman et al. | 220/712 |
| 6,314,866 | B1 * | 11/2001 | Melton | 99/322 |
| 6,460,725 | B1 | 10/2002 | Portman et al. | |
| 7,195,130 | B2 * | 3/2007 | Pendergrass et al. | 220/254.1 |
| 2004/0217119 | A1 | 11/2004 | Portman et al. | |
| 2005/0092748 | A1 * | 5/2005 | Durdon | 220/254.3 |

FOREIGN PATENT DOCUMENTS

| | | |
|---|---|---|
| GB | 931533 | 7/1963 |
| GB | 2281852 | 3/1995 |
| GB | 2368333 | 5/2002 |

* cited by examiner

*Primary Examiner*—Robin Hylton
(74) *Attorney, Agent, or Firm*—Sand & Sebolt

(57) ABSTRACT

A lid for a beverage container for holding a decoction beverage, preferably a disposable tea container with a base plate and a covering arranged at a distance from the base plate in which case between the base plate and the covering a holding space bounded on the sides by a surrounding side wall is formed, a first opening being provided in the base plate through which a decoction unit holding decoction materials can be guided and a second opening smaller than the first opening being formed in the covering or in the region of the covering through which a section of the decoction unit can be guided, the holding space being of dimensions such as to hold at least part of the decoction unit. This lid is especially suitable for covering beverage containers in which decoction beverages, especially for "sale on the street" are to be prepared. The decoction unit may be used without having to remove the lid from the beverage container.

18 Claims, 4 Drawing Sheets

LID FOR A BEVERAGE CONTAINER TO HOLD A DECOCTION BEVERAGE

The invention concerns a lid for a beverage container for holding a decoction beverage, preferably for a disposable teacup.

It is known that hot beverages, e.g., can be sold to be taken out at kiosks or other sales outlets set up for this purpose. In such cases the hot beverage is typically sold in a disposable drinking container, e.g., of cardboard or Styrofoam. These disposable cups or containers in such cases are usually closed with a lid which, on the one hand, is supposed to keep the hot liquid from spilling, and on the other, to keep it hot.

Such cup-lid combinations are known, e.g., for coffee where the lid for such a coffee container is usually a simple plastic lid with a clamping edge around its circumference. In this case either a single opening or a raised drinking spout with an opening is provided near the edge of the lid through which the hot coffee can be drunk from the container without removing the lid The goal of the invention is now to make it possible to sell tea in a manner comparable to the above mentioned "street sale" of hot coffee to be consumed off the premises. At the same time the tea must satisfy certain quality requirements, especially it must be possible to have tea brewed with fresh tea leaves.

The problem of the invention is therefore to devise a lid for a beverage container to hold a decoction beverage with which tea or another decoction beverage can be prepared and can be securely closed in a beverage container and sold to a customer on the street.

This problem is solved by the lid shown in attached FIGS. 1-7(*c*).

According to the invention, the lid has a base plate as well as a cover arranged at a distance from the base plate. Between the base plate and the cover a holding space is formed which is bounded by side walls surrounding it on the sides. In the base plate a first opening is provided. The latter is of such dimensions that a decoction unit containing decoction material can be guided through it. In the cover or in the region of the same a second opening is formed smaller than the first opening formed in the base plate. This opening is of such size that at least one section of the decoction unit can be guided through it. Finally the holding space is dimensioned to hold at least part of the decoction unit.

With the lid according to the invention a decoction unit, preferably a decoction pouch containing tea leaves, can be suspended through the opening formed in the base plate in the interior space of the beverage container, especially a disposable tea container. In this case is envisioned that a section of the decoction unit, especially a handle is affixed which passes through the second opening formed in the cover and is affixed to the lid in a suitable way. The decoction unit passes through the opening formed in the base plate of the lid advantageously to such a length that it extends into the beverage container far enough that it comes in contact with the hot water or other brewing liquid contained in it. After the end of the brewing time the decoction unit can be grasped on the section extending through the opening formed in the covering and pulled out through said opening. At this time the part of the decoction unit extending through the opening formed in the base plate is at least partially pulled into the holding space formed between the base plate and the cover. In particular, at this time the decoction unit is pulled far enough out of the beverage container that it is no longer in contact with the decoction liquid, especially the hot water or the decoction beverage formed in the meanwhile In this way the lid according to the invention fulfills at least two functions. On the one hand it covers the beverage container with the decoction beverage contained in it reliably so that an inadvertent spilling as well as premature cooling is avoided in the case when a hot decoction beverage is involved. On the other hand, the lid according to the invention serves for simple manipulation of a decoction unit which can extend through said lid for the preparation of a decoction beverage in a decoction or brewing liquid and then without lifting the lid can also be removed from it in a simple way.

In particular it is possible with the lid according to the invention to prepare tea in the form of tea leaves in a decoction pouch for preparation of a high-quality tea in a disposable tea container, e.g., for "street sale".

The lid is preferably fabricated from a plastic, especially by deep drawing. Alternatively the lid, however, may also be formed from a paper or cardboard material by a suitable shaping process. The lid is preferably formed of two elements, one part representing the cover, the remaining part being fabricated as one piece.

According to an advantageous variant of the invention, the second opening is formed as a slit. In this way the opening formed in or in the region of the cover is of particularly small dimensions so that both the risk of spilling of the contents of the beverage container through said opening as well as the possibility of premature cooling of a hot beverage contained in it is reduced. Especially preferably the slit shaped opening can be further covered by a tongue-like or tab-like part of the cover and be essentially closed in a resting position.

Another advantageous modification of the invention envisions that the lid has a preferably encircling clamping edge for clamping onto the beverage container. With such a clamping edge the lid can be safely and reliably affixed to the beverage container without the risk that the lid may become inadvertently detached from the beverage container or fall off.

In another variant of the invention, it is envisioned that the covering is arranged sloping at an acute angle to the base plate. By this type of arrangement a holding space with a wedge-shaped cross-section is created. Such a wedge-shaped holding space is advantageous, on one hand, for holding the decoction unit, and also satisfies the purpose of guiding the decoction unit when it is pulled in as will be explained in more detail later with reference to the description of the example of the embodiment.

According to another advantageous feature of the invention, the lid displays guiding surfaces sloping with respect to the base plate for guiding a section of the handle of the decoction unit. Such sloping guiding surfaces provide support during the wedging of the decoction unit in the holding space after it has been pulled through the opening in the bottom plate. As a result the decoction unit, on one hand, is "wrung-out" by squeezing and on the other, it is held in the holding space.

The acute angle enclosed between the base plate and the guiding surfaces is advantageously larger than the acute angle between the bottom surface and the cover.

The lid is also constructed so that the decoction unit can be pulled along a plane running obliquely through the holding space through the first opening and second opening respectively. In this way the possibility arises of pulling a larger section of the decoction unit into the interior of the holding space than if the two openings in the base plate and the covering were arranged aligned with each other. The rest arranged in the region of the base plate lying opposite the second opening for a part of the handle of the decoction unit creates the possibility of affixing the decoction unit to the lid in a position in which it extends as far as it can through the opening in the base plate so that it cannot pass completely through the opening in the base plate.

Advantageously the lid has a drinking opening in a region of the edge which forms a connection to the inner space of the beverage container when the lid is seated on the beverage container. Such a drinking opening permits the contents of the beverage container to be consumed without having to remove the lid from the beverage container.

The drinking opening is preferably arranged diametrically opposite the second opening arranged in an edge region of the lid. In this way during drinking through the drinking opening any influence by the section of the decoction unit protruding out of the second opening is avoided.

Finally, the lid and a decoction unit may be kept on hand already assembled in order to simplify the preparation of a decoction beverage. A decoction beverage can be prepared by introducing a decoction liquid, especially hot water for tea, into a beverage container, e.g., a disposable tea container and subsequently putting on the lid, already assembled with the decoction unit, e.g., the tea pouch. The beverage can be handed over to the consumer directly in this constellation. The latter after a certain time determined by himself can remove the decoction unit by pulling the section extending out of the second opening out of the decoction liquid and enjoy the freshly prepared decoction beverage.

Other advantages and features of invention may be derived from the following description of examples of embodiment with reference to the appended figures, in which.

Figure 1:
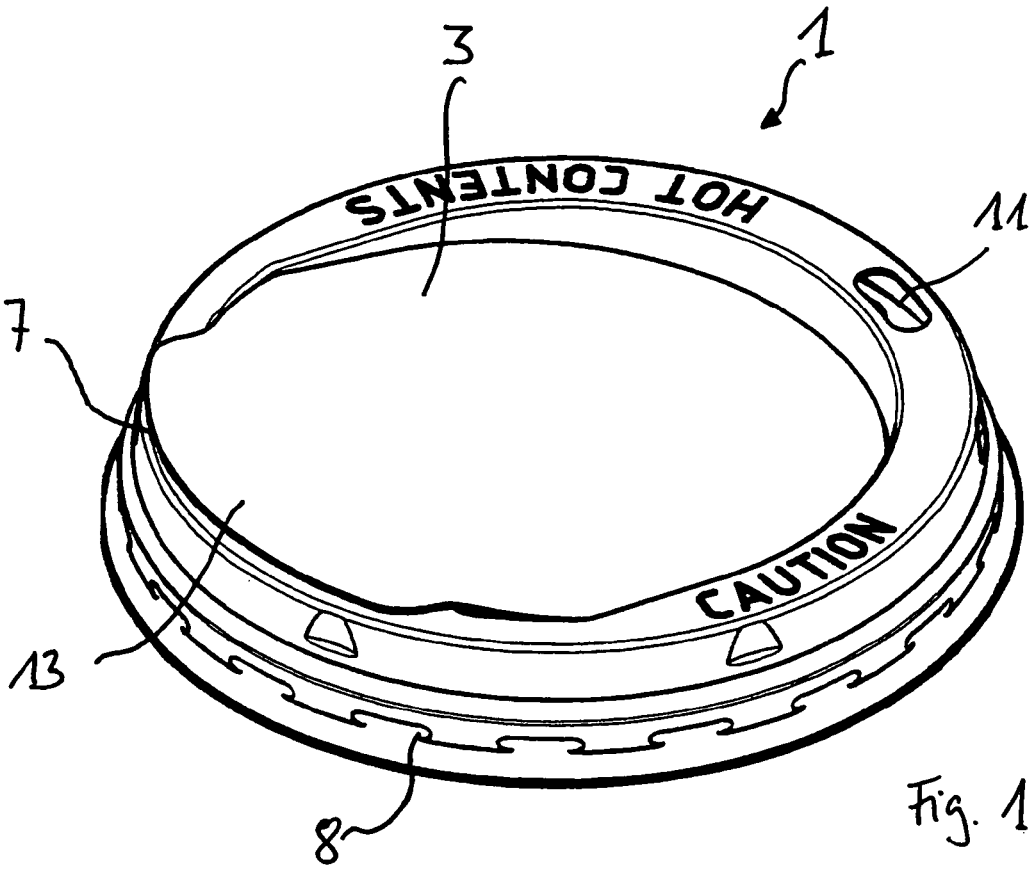
FIG. 1 is a three-dimensional view of a lid according to the invention.
Figure 2:
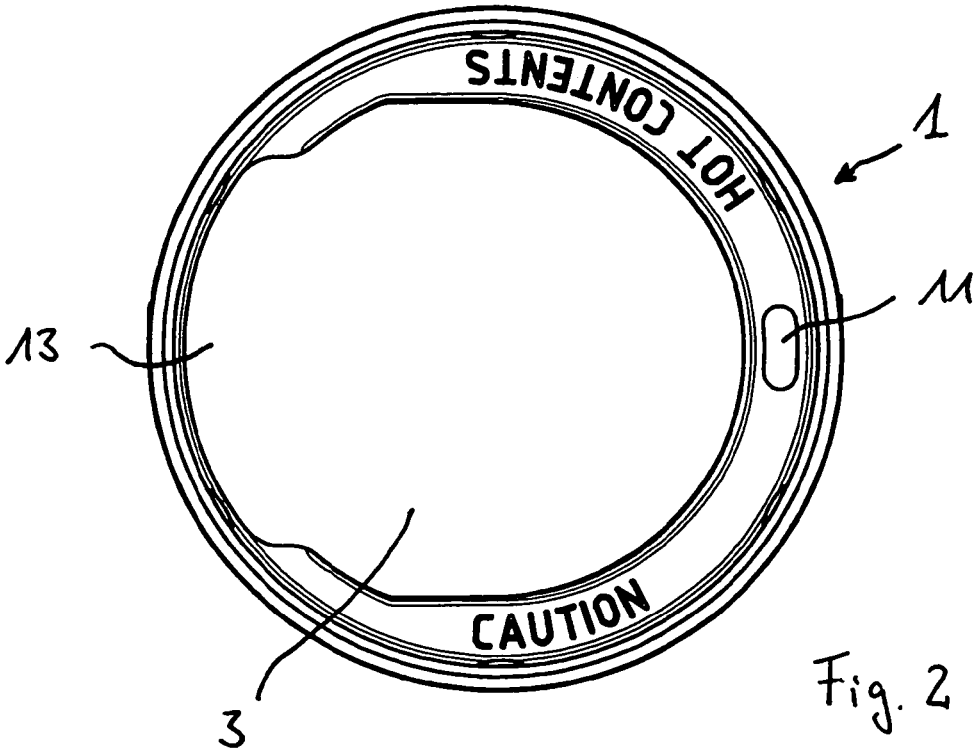
FIG. 2 shows the lid in FIG. 1 from above.
Figure 3:
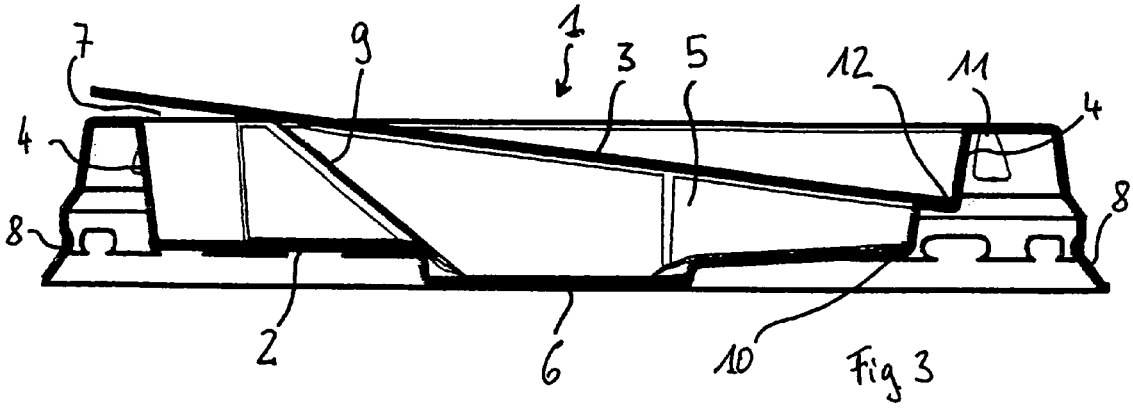
FIG. 3 is a cross-section through the lid shown in FIGS. 1 and 2
Figure 4:
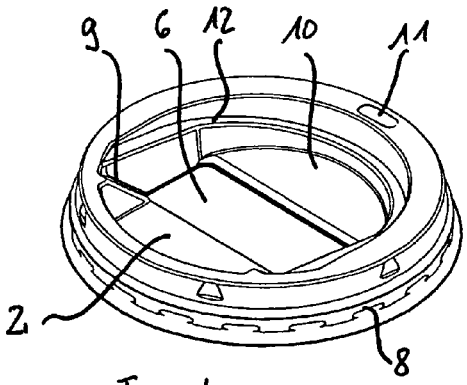
Figure 5:
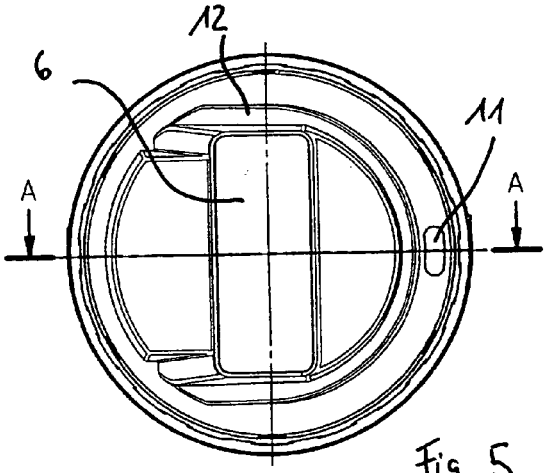
Figure 6:
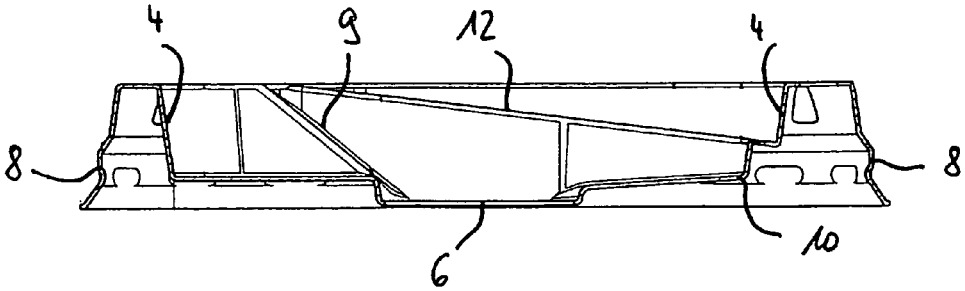
Figure 3A:
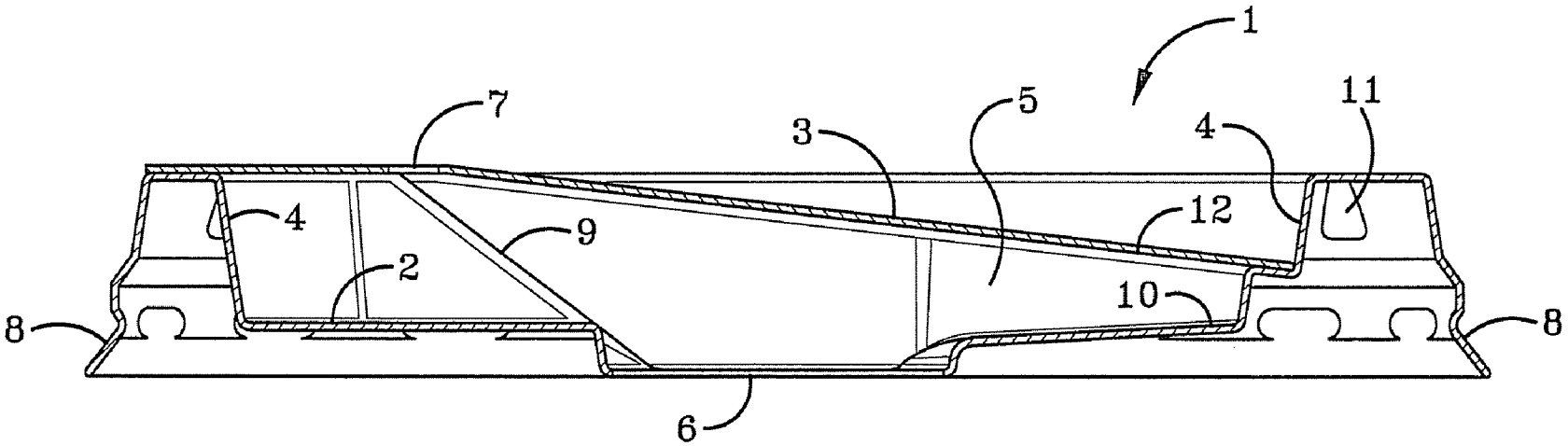

FIG. 3*a* is a cross-section through the lid shown in FIGS. 1 and 2, showing the second opening in the cover;

FIG. 4 shows the lid according to the invention without the cover, in a three-dimensional view;

FIG. 5 lid without cover, top view;

FIG. 6 is a sectional representation along line A-A in FIG. 5, and

Figure 7:
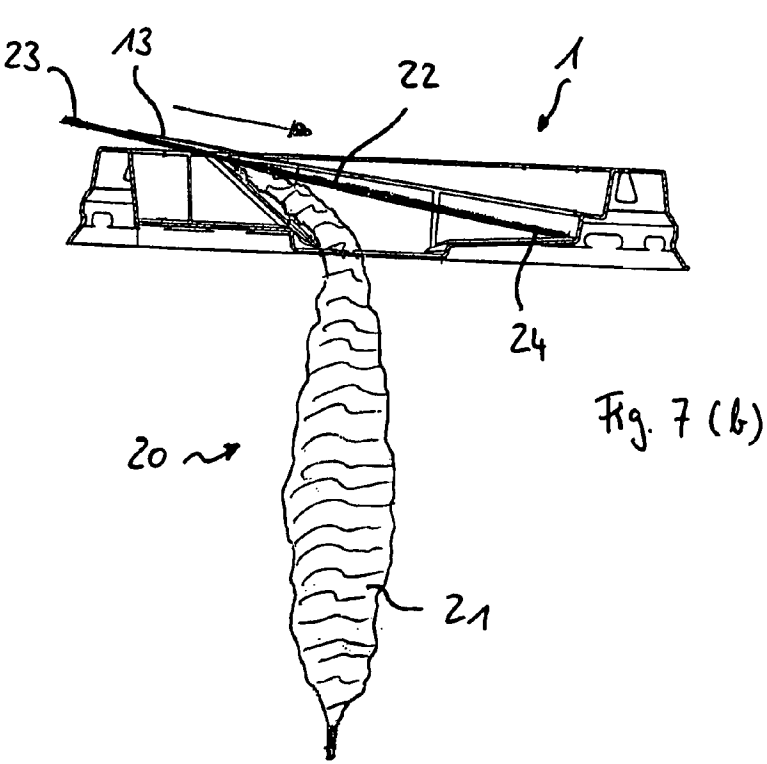
Figure 7:
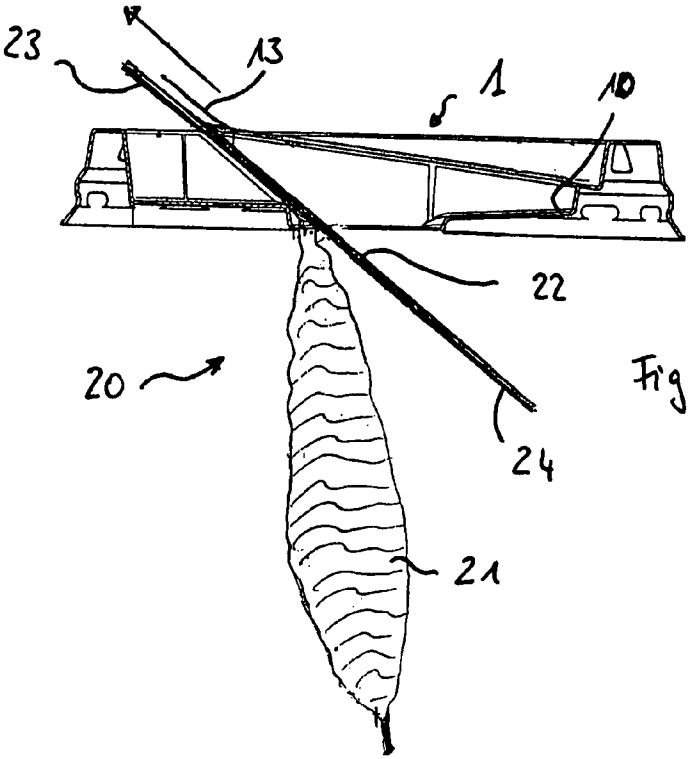
Figure 7:
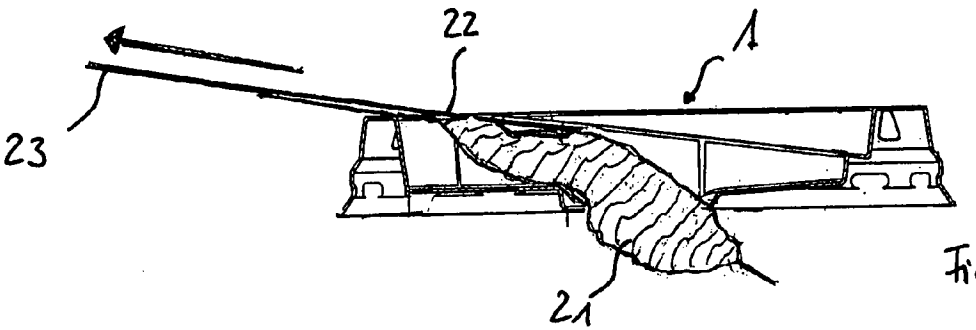

FIG. 7(*a*) through 7(*c*) schematically illustrate the use of the lid according to the invention together with a decoction unit in three different sectional representations.

The figures show an example of embodiment of a lid according to the invention. The same elements are provided with the same reference numbers.

To describe the lid according to the invention first reference is made to FIGS. 1 through 6 taken as a whole. The lid according to the invention is generally denoted in the figures by 1. This lid 1 has a bottom plate 2 and a cover 3. Between the bottom plate 2 and the cover 3 bounded on the side by a surrounding side wall 4 a holding space 5 is formed. The cover 3 is arranged sloping at an acute angle with respect to the bottom plate 2.

In the bottom plate 2 a first opening 6 is formed. This opening 6 is essentially rectangular with rounded off corner regions. In a first direction viewed along the shorter length of the essentially rectangular opening 6 the opening 6 lies in the center of the bottom plate 2. In the direction of its longer dimension the opening 6 extends essentially over the entire width of the bottom plate 2.

In the region of the cover 3, more precisely, between the bottom side of the cover 3 and the side wall 4 a second opening 7 is located. This opening 7 is essentially formed as a slit and is covered by a flap-shaped extension of the cover (flap 13). FIG. 3*a* shows an alternative embodiment of the lid where the second opening 7 is located in the cover 3.

The lid 1 has a surrounding clamping edge 8 with which it can be affixed on a beverage container, preferably a disposable tea container. In a region outside of the side wall 4, therefore, starting at the side wall 4 running in the direction of the clamping edge 8 a drinking opening 11 is arranged in the upper edge of the lid 1. The bottom plate 2 in one section has a rest 10 whose function will be explained later.

The cover 3 is placed on a resting edge 12 formed as a ledge in the side wall 4.

The lid 1 is constructed entirely of two parts, the cover 3 being a separate component. The rest of the lid is fabricated in one piece by deep drawing of plastic. For final assembly of the lid 1 the cover 3 is placed on the resting edge 12 and there affixed in a suitable way, e.g., by gluing, welding or the like.

The FIGS. 7(*a*) through 7(*c*) show how the lid 1 according to the invention is used in connection with a decoction unit 20. FIG. 7(*a*) shows how a decoction unit 20 is inserted in the lid 1. The decoction unit 20 has a pouch part 21 in which decoction material such as tea leaves is held The pouch part 21 is arranged on a handle 22. The handle 22 is plate shaped and preferably formed from paper or cardboard material. The pouch part 21 is formed on handle 22 in such a way that sections of the handle 22 extend on both sides of the connection site between the pouch part 21 and handle 22, i.e. the grasping section 23 and a supporting section 24.

To insert the decoction unit 20 the latter is inserted with the gripping section 23 in front from the bottom through the opening 6 into the lid 1 until the gripping section 23 passes through the opening 7. At this time the handle 22 is guided during the insertion on the guiding surface 9 so that the gripping section 23 can be securely passed through the opening 7. In this first step, as shown in FIG. 7(*a*) the flap 13 is bent around. The direction of motion is indicated in FIG. 7(*a*) by an arrow. When the entire supporting segment 24 of the handle 22 is located on the far side of the edge of opening 6 lying opposite opening 7 the handle 22 is swiveled and pushed so far back into the holding space 5 that the supporting section 24 lies with its edge on the outermost end of the rest 10. This is shown in FIG. 7(*b*), the direction of movement being indicated by the arrow. In this position the decoction unit 20 is securely fixed to the lid 1 and the pouch part 21 extends by the maximal length out of opening 6 of the bottom plate 2 of the lid 1. The pouch part 21 of the decoction unit 20 can therefore, e.g., extend jointly into hot water located in a disposable drinking container on which the lid 1 with a decoction unit 20 inserted is seated and serve to prepare the decoction beverage.

If the decoction beverage is already prepared, the handle 22 on the gripping section 23 is grasped and pulled out in the direction of the arrow shown in FIG. 7(*c*) from the opening 7. At that time the pouch part 21 of the decoction unit 20 is pulled into the holding space 5. The pouch part 21 is then at least partially enclosed in the holding space 5. In this step the pouch part 21 is also squeezed and "wrung out" so that decoction beverage still held in the pouch part 21, e.g., in the case of a disposable drinking container, runs back. In particular, the pouch part 21 after the gripping section 23 is pulled our or the pouch part 21 pulled into the holding space 5, is no longer in contact with the decoction beverage so that, for example, in the case of tea one cannot draw too long and too much bitter substances out of the tea into the hot water or decoction.

The decoction unit 21 then remains in the last-mentioned position. The decoction beverage held in the beverage container can be drunk through the opening 11 without having the decoction beverage come into further contact with the pouch part 21 of the decoction unit 20. This means the lid need not be taken off in order to remove the pouch part 21 from the decoction beverage but can remain on the beverage container and prevent spilling or premature cooling of the beverage.

With the lid 1 according to the invention it is possible to prepare decoction beverages of high-quality, especially high-quality teas and especially to offer them in disposable drinking containers for sale on the street.

LIST OF REFERENCE NUMBERS

1 lid
2 bottom plate
3 covering
4 side wall
5 holding space
6 opening
7 opening
8 clamping edge
9 guiding surface
10 rest
11 drinking opening
12 resting edge
13 flap
20 decoction unit
21 pouch part
22 handle
23 gripping section
24 supporting section

The invention claimed is:

1. A lid for a beverage container for holding a decoction beverage, for a disposable tea container; said lid comprising:

a base plate;

a cover arranged at a distance from the base plate; and wherein the cover is arranged sloping at an acute angle to the base plate;

a holding space being formed between the base plate and the cover and bounded by a circumferential side wall; wherein the side wall includes a circumferential clamping edge adapted to engage a rim of a beverage container and oriented so that when the rim of the beverage container is engaged thereby, the base plate is disposed intermediate the beverage container and the cover;

a first opening being provided in the base plate through which a decoction unit containing a decoction material can be guided; and a second opening smaller than the first opening being formed in one of the cover and between the cover and the side wall, through which a section of the decoction unit can be guided, said holding space being of such dimensions as to hold at least part of the decoction unit.

2. The lid as in claim 1, further comprising at least one guiding surface slanted with respect to the base plate for guiding a section of a handle of the decoction unit.

3. The lid as in claim 2, wherein an acute angle enclosed between the base plate and the guiding surface is larger than the acute angle between the base plate and the cover.

4. In combination:

a lid for a beverage container for holding a decoction beverage, said lid comprising:

a base plate;

a cover arranged at a distance from the base plate; wherein the cover is arranged sloping at an acute angle to the base plate;

a holding space being formed between the base plate and the cover and bounded by a circumferential side wall, wherein the side wall includes a clamping edge adapted to engage a rim of a beverage container and oriented so that when the rim of the beverage container is engaged thereby, the base plate is disposed intermediate the beverage container and the cover;

a first opening being provided in the base plate;

a second opening smaller than the first opening being formed in one of the cover and between the cover and the side wall; and a decoction unit with a pouch containing tea leaves, arranged in the lid, penetrating the base plate through the first opening, with a gripping section guided out of the holding space through the second opening.

5. The combination as in claim 4, wherein the lid further comprises at least one guiding surface slanted with respect to the base plate for guiding a section of a handle of the decoction unit.

6. The combination as in claim 5, wherein an acute angle enclosed between the base plate and the guiding surface of the lid is larger than the acute angle between the base plate and the cover.

7. The lid as in claim 1, wherein the second opening is formed as a slit.

8. The lid as in claim 1, wherein when viewed in cross-section, the first opening in the base plate is arranged approximately in the center and the second opening is offset toward one edge of the cover relative to the first opening in one of the cover and the region of side wall proximate the cover; and wherein in a region lying diametrically opposite the second opening, the base plate has a rest for a part of a handle of the decoction unit.

9. The lid as in claim 1, further comprising a drinking opening in an edge region which creates, when the lid is seated on the beverage container, a connection to the inner space of the beverage container.

10. The lid as in claim 9, wherein the drinking opening is arranged diametrically opposite the second opening.

11. The lid as defined in claim 1, wherein the smaller second opening comprises a slit that is formed between the cover and the side wall.

12. The combination as defined in claim 4, further comprising a drinking opening being provided in an upper edge of the lid, where the drinking opening is not in fluid communication with the holding space.

13. A lid for a beverage container for holding a decoction beverage; said lid comprising:

a base plate;

a cover arranged at a distance from the base plate; and wherein the cover is arranged sloping at an acute angle to the base plate;

a holding space being formed between the base plate and the cover and bounded by a circumferential side wall;

a first opening into the holding space being provided in the base plate and through which a decoction unit containing a decoction material can be guided; and a second opening into the holding space being provided in one of the cover and between the cover and side wall, said second opening being smaller than the first opening and through which a section of the decoction unit can be guided, said holding space being of such dimensions as to hold at least part of the decoction unit; and a drinking opening being provided in an upper edge of the lid, where the drinking opening is not in fluid communication with the holding space.

14. The lid as in claim 13, further comprising at least one guiding surface slanted with respect to the base plate for guiding a section of a handle of the decoction unit.

15. The lid as in claim 14, wherein an acute angle enclosed between the base plate and the guiding surface is larger than the acute angle between the base plate and the cover.

16. The lid as defined in claim 13, wherein the smaller second opening comprises a slit that is formed between the cover and the side wall.

17. A method of brewing and drinking a decoction beverage comprising:

providing a disposable beverage container that includes an interior chamber suitable for holding a quantity of liquid therein; said container having a circumferential rim;

providing a detachable lid for engagement with the container; said lid including a base plate; a cover arranged at a distance from the base plate and sloping at an acute angle relative thereto; a holding space formed between the base plate and the cover and bounded by a circumferential side wall, where the side wall includes a circumferential clamping edge complementary to the rim of the container; and wherein the lid further includes a first opening into the holding space provided in the base plate; a second opening into the holding space provided in one of the cover, and between the cover and side wall, where said second opening is smaller than the first opening; and a drinking opening provided in an upper edge of the lid, where the drinking opening is not in fluid communication with the holding space;

inserting a tab of a decoction unit holding a decoction material through the first opening, through the holding space and at least partially through the second opening;

pulling the tab outwardly from the second opening to a degree sufficient to cause at least a portion of the decoction unit to extend outwardly from the holding space through the first opening and extend for a distance outwardly away from the base plate of the lid;

pouring a quantity of liquid into the beverage container;

engaging the clamping edge on the lid with the rim of the container; whereby the portion of the decoction unit is immersed in the liquid;

allowing a desired quantity of time to elapse;

pulling the tab further outwardly from the second opening such that the decoction unit is substantially drawn into the holding space in the lid and out of the liquid.

18. The method as defined in claim 17, further comprising the step of drinking the brewed decoction beverage through the drinking opening in the lid.

* * * * *